United States Patent [19]

Rudish et al.

[11] Patent Number: 4,532,519

[45] Date of Patent: Jul. 30, 1985

[54] PHASED ARRAY SYSTEM TO PRODUCE, STEER AND STABILIZE NON-CIRCULARLY-SYMMETRIC BEAMS

[76] Inventors: Ronald M. Rudish, 50 Bethany Dr., Commack, N.Y. 11725; Peter J. McVeigh, 10 Thomas Dr., Hauppauge, N.Y. 11787

[21] Appl. No.: 311,464

[22] Filed: Oct. 14, 1981

[51] Int. Cl.[3] ..... H01Q 3/22; H01Q 3/24; H01Q 3/26

[52] U.S. Cl. ..... 343/372; 343/420; 343/368

[58] Field of Search ..... 343/368, 371, 372, 373, 343/377, 442, 420, 425

[56] References Cited

U.S. PATENT DOCUMENTS

| | | | |
|---|---|---|---|
| 3,646,558 | 2/1972 | Campanella | 343/372 |
| 3,877,012 | 4/1975 | Nelson | 343/377 |
| 3,999,182 | 12/1976 | Moeller et al. | 343/408 |
| 4,041,501 | 8/1977 | Frazita et al. | 343/844 |
| 4,117,494 | 9/1978 | Frazita | 343/368 |
| 4,228,436 | 10/1980 | DuFort | 343/373 |

*Primary Examiner*—Theodore M. Blum
*Assistant Examiner*—Gregory C. Issing

[57] ABSTRACT

A phased array antenna system for eliminating antenna induced errors and distortions comprising an antenna array consisting of orthogonal rows and columns of antenna elements in which each row of elements is supplied signal power by a single beam forming network. Each input port of the beam forming network corresponds to an element of only one of a number of composite beam constituents which, when combined, form the complete composite beam. The beam constituents are adjusted in position to correct the composite beam shape as necessary by means of plurality of phase shifters, each of which is placed in series with only one input port of the beam forming networks. This unique positioning of the phase shifters in the antenna distribution system reduces the total number of phase shifters required to control the beam, permits the forming of a shaped beam such as a fan beam without the need for amplitude control and simplifies the complexity of the phased array control system.

8 Claims, 15 Drawing Figures

PHASED ARRAY SYSTEM TO PRODUCE, STEER AND STABILIZE NON-CIRCULARLY-SYMMETRIC BEAMS

BACKGROUND

1. Field

This invention relates to phased array antenna systems which produce non-circularly symmetric beams, and more particularly, to improvements in the distribution system of such systems which enables them to electronically stabilize beam orientation and beam shape.

2. Prior Art

Phased array antennas are often configured to produce non-circularly-symmetric beams, such as the fan beam which is much wider in one direction through the beam than in the orthogonal direction through the beam. An example is the typical beam produced by a search radar, which is usually narrow in azimuth and wide in elevation. The search radar's vertical fan-shaped beam is scanned in azimuth to sweep through the full search coverage-volume of space. Most prior art fan beams of this type have been produced by antennas which use specially contoured reflectors that are rotated to steer the beam. The speed of such systems is severely limited by mechanical inertia; however, the inertia may be eliminated through the use of electronically scanned phased array antennas. Unfortunately, prior art phased array fan beams present other problems, most notable of which is distortion, referred to as coning, which occurs as the fan beam is scanned off bore sight.

The cause of coning will be explained with the aid of FIG. 1, which is a three dimensional graphical diagram of the antenna patterns produced by a planar phased array. The diagram of FIG. 1 comprises an X axis 101, a Y axis 102, a Z axis 103, a phased array antenna 104 lying in the X-Y plane, antenna elements 105, representative left end antenna element 106, representative right end antenna element 107, antenna beam direction vector 108 ending at point 120, ray 109 between element 106 and point 120, ray 110 between element 107 and point 120, ray 111 between element 106 and a point 121, ray 112 between element 107 and point 121, ray 113 between element 106 and a point 122, ray 114 between element 107 and the point 122, ray 115 between element 106 and a point 123 and ray 116 between element 107 and the point 123.

The direction vector 108, which emanates from the origin and extends to the point 120, represents the direction of the beam produced by a particular phasing of the elements of the phased array antenna 104. The position of the direction vector may be defined conveniently in two ways. The first way is by means of the direction angles $\alpha$ 127, $\beta$ 129 and $\theta$ 126 which are the angles the direction vector makes with the X, Y, and Z axes, respectively. The second way is through the use of spherical coordinate angles which are the angle $\phi$ 128 between the projection of the direction vector 118 on the X-Y plane and the X-axis and the angle $\theta$ between the direction vector and the Z axis.

When the phase of the signals to the two representative antenna elements 106 and 107 is adjusted to direct the beam at point 120, it may be represented by the direction vector 108. Only these two antenna elements will be used for illustrative purposes, it being understood that the remaining elements are similarly phased properly to produce the desired fan beam, the complete array normally comprising rows and columns of elements of which element 106 and 107 are only two. For the phasing required to produce direction vector 108, the beam will appear anywhere the rays from the antenna elements 106 and 107 remain the same in length, as for example, at point 121 where rays 111 and 112 drawn from elements 106 and 107 to point 121 are the same in length as rays 109 and 110 respectively drawn from the same elements to point 120. The locus of points that meets this criteria is the curve 119, which includes the points 120 and 121. This curve represents the coning distortion occurring in conventional fan beam arrays as the beam is scanned off bore sight.

Bore sight is the Z axis in FIG. 1, as it is orthogonal to the X-Y plane in which the antenna array 104 lies. If, for example, it is assumed that the phasing of the signals is changed to produce a direction vector 124, which lies along the Z axis and terminates in point 122, then equal length rays 113 and 114 may be drawn to point 124 from antenna elements 106 and 107. Similarly, if a direction vector 125 is drawn along the X axis to a point 123, equal length rays 115 and 116 may be drawn from antenna elements 106 and 107 to the point 123. The phasing in this case produces a locus of points which lie in the X-Z plane.

The antenna pattern produced by the phasing for direction vector 124, is an undistorted fan beam generally lying in the X-Z plane. The usually narrow, flat pattern shape of this beam can be seen in a cross section through the beam taken in a plane orthogonal to the direction vector 124. On the other hand, a fan beam produced off bore sight, say along the direction vector 108, is distorted because it is bowed lying along the curve 119. The curved pattern of this beam can be seen by taking cross section through the beam in a plane orthogonal to the direction vector 108.

FIG. 2 is a spherical graph showing an undistorted fan beam on bore sight as well as a distorted beam off bore sight. This Figure comprises a spherical graph 201, a zero degrees latitude line 202, a zero degrees longitude line 203 and the intersection 209 of these two lines. The angles of latitude and longitude line are aportioned along these lines with the intersection being taken as the zero reference.

FIG. 2 may be related to FIG. 1 by considering the sphere as being centered about the origin of FIG. 1 and oriented so that the Z axis of FIG. 1 passes through the intersection 209. A plot of the fan beam cross sectional pattern about the intersection 209 with the sphere so oriented provides the bore sight pattern. Typical contour lines 204 and 205 in FIG. 2 are the 3 dB and 10 dB fan beam cross sectional pattern on bore sight with the sphere so oriented. The 3 dB and 10 dB patterns for 45 degrees off bore sight are given by contour lines 206 and 207 respectively. The 10 dB pattern for 90 degrees off bore sight is given by contour line 208. The increase in the distortion due to coning at angles off bore sight is evident from the change from the relatively straight and undistorted pattern 204 on bore sight to the curved and significantly distorted pattern 206 off bore sight.

The distortion of the fan beam as it is scanned could cause operational problems for some applications. In search radars, it could cause the azimuth angle reported for the target to be in error, the magnitude of error depending on the elevation of the target. In a Microwave Landing System (MLS) application, the curvature of the fan beam would cause an erroneous indication of aircraft position.

The principal method of correcting this problem, in the prior art has been by computation. An example is the computed compensation applied to the airborne receivers of microwave landing systems which utilizes the coning type electronically scanned antennas. Since both azimuth and elevation angles are measured in this system, each can be used to compute a correction of the other. Such an approach is used in the Time Reference Scanning Beam (TRSB) system adopted by the International Civil Aviation Organization (ICAO) as the international standard Microwave Landing System (MLS). The obvious disadvantage of this approach is the need for computational capability at each receiver and the penalty in cost, size and weight which it carries. However, there is an additional disadvantage which is more subtle. For very wide angles of scan, the coning is so extreme that there is a loss of coverage; the receivers may totally lose contact with a transmission sent over a widely scanned beam.

A second method of dealing with the coning beam problem in the prior art has been to avoid it entirely by using cylindrical arrays. These naturally produce planar (non-coning) beams as they are scanned. The disadvantage of this approach is that cylindrical arrays require more components than planar arrays and thus are costlier, larger and heavier.

A different type of problem is encountered in many applications where a fan-beam producing antenna is mounted on a vehicle subject to attitude rotations such as pitch and roll. These rotations skew the orientation of the fan beam and could result in loss of intended coverage or in direction-finding errors. Considering again the example of a search radar, pitch or roll of the vehicle on which the radar is mounted could result in a significant difference between the azimuth to a target in stable coordinates (referenced to the vehicle's heading) and azimuth to the target in the antenna's coordinates ("deck-plane" coordinates, also referenced to vehicle heading). This difference will be a function of the target elevation and its relative bearing; the difference, $\Delta$, is given by the equation:

$$\Delta = \tan^{-1}\left[\frac{\cos R\sin\theta\sin\phi - \sin R\cos\theta}{\cos P\sin\theta\cos\phi + \sin P\sin R\sin\theta\sin\phi + \sin P\cos R\cos\theta}\right] - \phi$$

where R = roll angle, P = pitch angle, $\theta$ and $\phi$ are spherical coordinates of target in a stable reference system which were defined in connection with FIG. 1. If the application is such that the target azimuth and elevation are not independently known, but are to be deduced from the radar's measurement, then this difference between the azimuths in the two coordinate systems is directly a direction-finding error. If a pitch of 10 degrees and then a roll of 24 degrees is assumed, the azimuth error can be as large as 27 degrees if the target is at a 40 degree elevation and at a relative bearing of 60 degrees.

Rotation of a scannable antenna about an axis that is perpendicular to the plane of scan can be compensated by adjustment of the amount of scan, although this also produces a change in shape of coning type beams. For antennas which can only scan in one plane, rotation of the antenna about an axis which is in the plane of scan is not as easily compensated.

The principal prior art method of compensating attitude rotation of the vehicle on which either mechanically or electrically scanned antennas have been mounted has been to mount the antenna on an intermediate platform which is mechanically stabilized. For example, the array antennas used for the U.S. Navy's AN/SLQ-32 shipboard system are mounted to roll stabilized platforms. Such platforms significantly increase the cost, size and weight of the system. A further disadvantage is the decreased system reliability imposed by the added moving parts.

Another prior art method for compensating such rotations of the vehicle is electronic stabilization by appropriately adjusting phase-shifters of an array. Such a method has been described by M. J. Kiss in the paper, "Roll Stabilization of Fan Beams on Airborne Electronically Scanned Phased Arrays" which was presented at the 23rd Annual USAF Antenna Symposium, Oct. 10–11, 1973. In this method, every radiator of a planar array is fed via a phase-shifter. A multi-processor computes those commands for each phase shifter which most nearly stabilize the plane in which the beam is shaped. It does this by computing the equation of the equiphase surface about the antenna which if produced by the antenna would yield the best approximation to the stabilized fan beam. Then it computes the relative phase of radiator excitations (phase-shifter commands) which would produce the best approximations to the desired equiphase surface. In general, the command for each phase shifter is different from that used to drive the others. These commands must be recomputed each time either the beam direction is to be changed or for each significant change in antenna attitude. The disadvantage of this approach is that it requires a phase shifter for every radiator and complex computations to set those phase shifters. Also, this method cannot correct the change in curvature of the fan beam as the beam is effectively steered in a direction orthogonal to the plane of beam shaping to carry out the stabilization process. This is because the Kiss method relies on only the adjustment of the phase of the signal applied to each radiator, whereas beam stabilization, without beam shape changes, requires adjustment of both the amplitude and the phase distribution across the antenna aperture.

SUMMARY

An object of the present invention is to provide a phased array antenna system capable of forming non-circular symmetric beams.

An object of the present invention is to stabilize the beam orientation to compensate for changes in attitude of the antenna mounting.

An object of the present invention is to electronically control the shape of the beam and thereby maintain the beam shape as it is scanned, or to electronically provide for changes in the beam shape in a prescribed manner.

An object of the present invention is to reduce the number of phase shifters required to control the position of beam constituents and to simplify the control system for the phase shifters.

The present invention overcomes the deficiencies of the prior art system in that it provides for stabilization of the shape and orientation of a fan beam or other shaped beam by eliminating the need for mechanical motion of the antenna, the need for phase shifters at every radiator, and the need for complex computations for as many phase shifter commands as there are radiators. The invention provides beam orientation stabilization which compensates for attitude changes of the antenna. This compensation is accomplished without distorting the beam shape. The invention also provides beam shape stabilization in that the beam shape remains undistorted throughout the scan.

The antenna system of the present invention is capable of forming a composite non-circular symmetrical beam, such as a fan beam, from the sum of a number (N) of beam constituents. Assuming for reference purposes, a composite fan beam lies in the horizontal plane, the half-power beamwidth of each fan beam constituent in the horizontal plane is approximately 1/N that of the composite beam width.

In the vertical plane, the beam width of each fan beam constituent equals that of the composite beam. The beam constituents are aligned to be adjacent in the horizontal plane in which the composite beam is wide and each constituent is spatially directed approximately a beamwidth apart so that their totality comprise the composite beam. The antenna's beam is usually scanned in a direction orthogonal to the wide dimension of the composite beam, which is the vertical plane when the fan beam is considered as lying initially in the horizontal plane. Scanning the composite beam without distortion is accomplished by scanning the beam constituents the required amounts to maintain the shape of the beam. Compensation for rotations of the antenna is also provided by simple adjustment of the amount of scan of each beam constituent.

The present invention comprises a phased array antenna composed of orthogonal rows and columns of antenna elements that are supplied by beam forming networks whose number is equal to the number of rows of antenna elements. The output ports of the beam forming networks are connected only to one row of antenna elements.

Each input port of a beam forming network accepts signal power to aid in forming an element of only one beam constituent. A phase shifter is inserted in series with each input port of the beam forming network to control the relative position of the beam constituent elements. This control permits shaping the composite beam and compensating for distortions such as coning found in prior art systems.

By placing the phase shifter before the beam forming network, the number of phase shifters required to control the beams is reduced as compared to conventional systems in which a phase shifter is required for every antenna element.

In addition, the position of the phase shifter in the present invention simplifies the control of the separate beams as compared to conventional systems which generally require a complex computer calculation for each phase shifter to make a change in the position of the beam constituents. Furthermore, the position of the phase shifter in the present invention enables them to cause the required changes in radiation for fan beam shape control during steering, obviating the need for separate signal amplitude control devices at each element.

DETAILED DESCRIPTION OF THE INVENTION

To clearly illustrate various novel aspects of the invention, a specific example is taken in which a planar phased array antenna, employed as the glide slope antenna of a microwave landing system, is mounted on board a ship and adjusted to produce a fan beam that is swept in elevation while the longitudinal axis of the pattern is maintained generally parallel to the horizontal plane.

Figure 1:
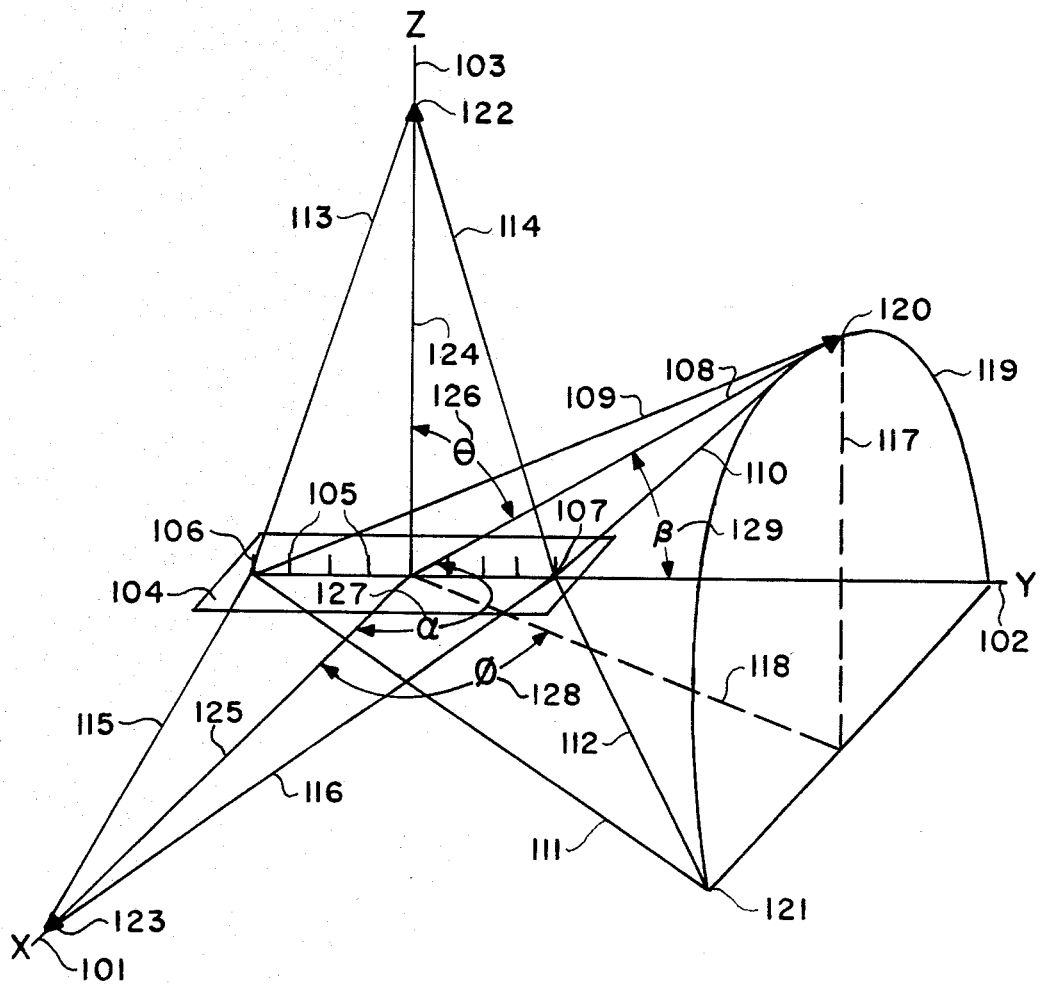
PRIOR ART FIGURE 1
FIG. 1 is a graphical representation of the beam shape produced by a planar phased array antenna system in various directions with respect to bore sight.
Figure 2:
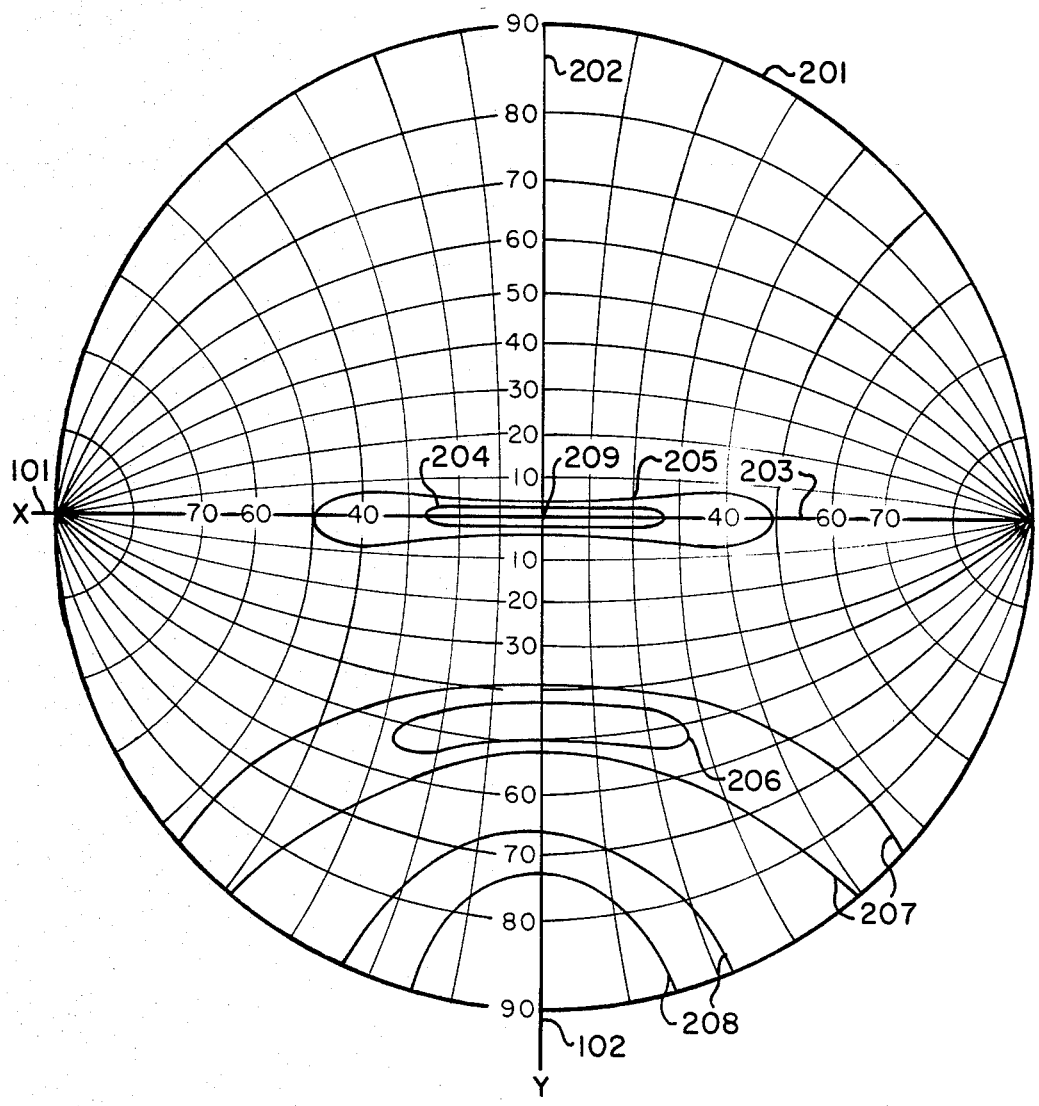
PRIOR ART FIGURE 2
FIG. 2 is a diagram illustrating the coning of a fan beam produced by a planar aperture when the beam is scanned off bore sight.
Figure 3A:
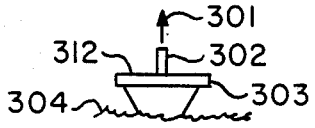
FIGS. 3*a* and 3*b* are diagrams illustrating the formation of a fan beam as a composite of constituent beams.
Figure 3B:
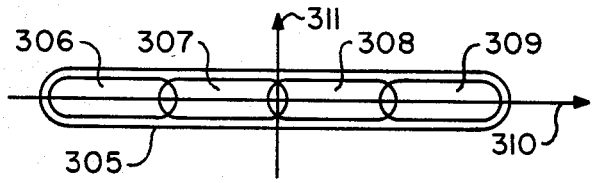

In FIG. 3A an array antenna 302 is shown mounted on the deck of a ship 303 which is positioned in an unrolled condition with the deck 312 generally parallel to the surface of the water 304. FIG. 3B is a plot showing the formation of a fan beam 305 from fan beam constituents 306 through 309. The contours shown are 3 dB down from the peak of the respective beams. An axis 311 drawn vertically through the center of the beam 305 is a true-vertical spatial axis. An axis 310 passing through the center of the fan beam in the longitudinal direction is orthogonal to the spatial vertical axis 311, while the ship is in the unrolled position. The vertical axis of the ship 301 coincides with that of the spatial vertical axis 311 because of the zero degree roll angle. The four constituent beams 306 through 309 are pointed apart in azimuth and steered to the same elevation angle to form the composite fan beam 305.

Figure 4A:
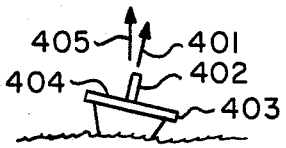
FIGS. 4*a* and 4*b* are diagrams illustrating the change in the orientation of an unstabilized fan beam due to antenna roll.
Figure 4B:
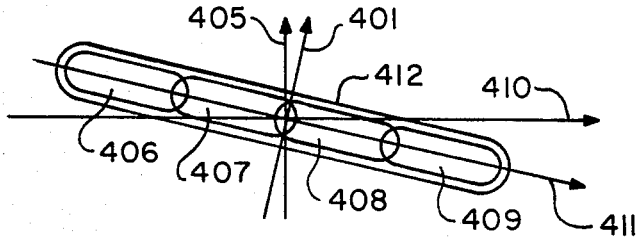

In FIG. 4A, the ship 403 and the array antenna 402 are placed in a rolled position. The roll angle is measured between the nominal vertical axis of the ship 401 and the true vertical 405. In FIG. 4B, the plane parallel to the surface of the ship's deck 404 which contains the wide dimension of the constituent beams 406 through 409 is shown in a position corresponding to the roll angle of the ship.

Figure 5A:
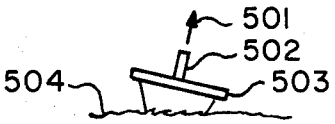
FIGS. 5*a* and 5*b* are diagrams illustrating the stabilization of a fan beam by differential steering of the constituent beams.
Figure 5B:
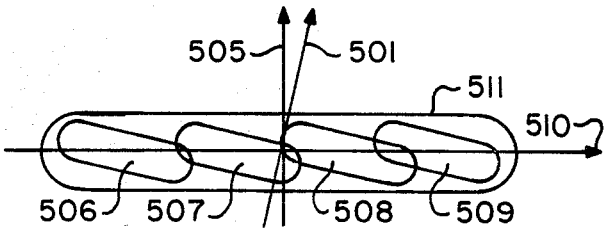

In FIG. 5A, the drawing numerals 501 through 505 correspond to 401 through 405 and the roll angle of the ship is the same as in FIG. 4A; however, the composite beam 511 in FIG. 5B has now been stabilized. The composite beam has been placed in the horizontal plane, even though the ship and antenna remain tilted at the roll angle. This has been accomplished by scanning constituent beams 506 through 509 back toward the true horizontal axis 510.

To test the ability of the present invention to provide compensation for a roll angle, a specific example of the use of beam constituents to form a composite beam was analyzed on a digital computer. The fan beam selected was 2 degrees high in the elevation plane and approximately 40 degrees wide in the azimuth plane. Each beam constituent was nominally 10 degrees wide and the four beam constituents were pointed at −15 degrees, −5 degrees, +5 degrees and +15 degrees in azimuth with respect to the planar array's broadside direction.

Figure 6:
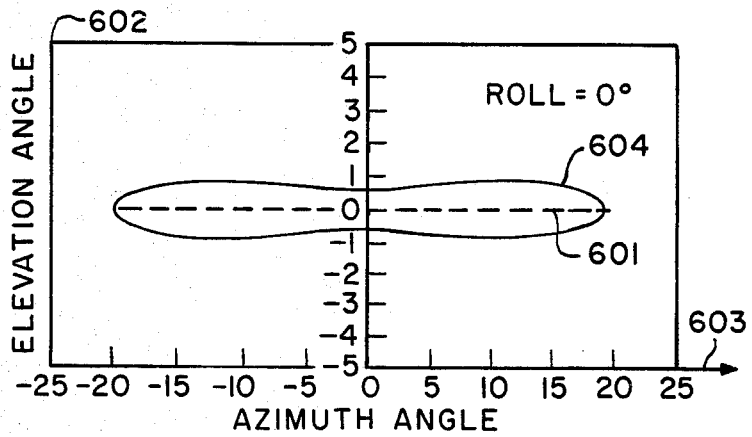
FIG. 6 is a graph illustrating the computed composite fan beam obtained by summing a specific set of constituent beams.

Constant amplitude contours of the composite were plotted as a function of azimuth and elevation angles for various roll angles in order to demonstrate the ability of the antenna to tilt the plane of the fan beam with respect to stationary spatial coordinates. In FIG. 6, the beam, which is pointed to array broadside at zero degree elevation is not tilted. In this representation, the elevation angle is apportioned along the vertical axis 602, the azimuth angle is apportioned along the horizontal axis 603, the contour 604 represents the 3 dB resultant composite pattern, and the dashed line 601 represents the longitudinal axis of the pattern.

Figure 7:
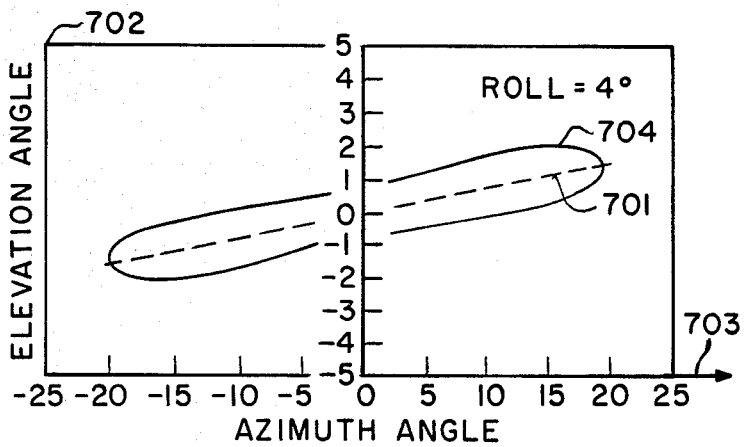
FIG. 7 is a graph illustrating the composite fan beam when it is electronically tilted 4 degrees.

In FIG. 7, the ordinate 702 represents the elevation angle, the abscissa 703 represents the azimuth angle, the contour 704 represents the 3 dB pattern and the dashed line 701 represents the longitudinal axis of the pattern. The fan beam is tilted 4 degrees by differential scanning of the beam constituents. The beam constituents were pointed to elevation angles given by the following equation:

$$\theta=(\phi)\ (\tan \sigma)$$

where:

$\sigma$=tilt angle $\phi$=azimuth pointing angle of the particular constituent beam $\theta$=required elevation pointing angle.

Figure 8:
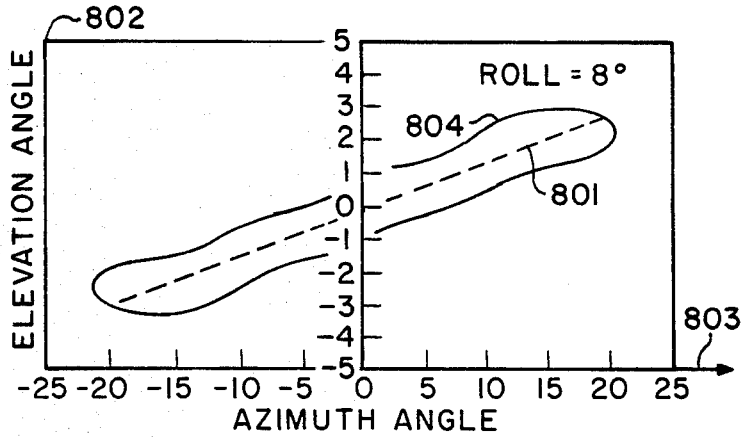
FIG. 8 is a graph illustrating the composite fan beam when it is electronically tilted 8 degrees.

FIG. 8 is a plot of the computer generated composite 3 dB pattern 801 for a beam that is tilted eight degrees by means of differential scanning of the beam constituents. The plot is made on a coordinate system in which the ordinate 802 represents the elevation angle, the abscissa 803 represents azimuth angle, the contour 804 represents the 3 dB contour and the dashed line 801 represents the longitudinal axis of the pattern.

Figure 9:
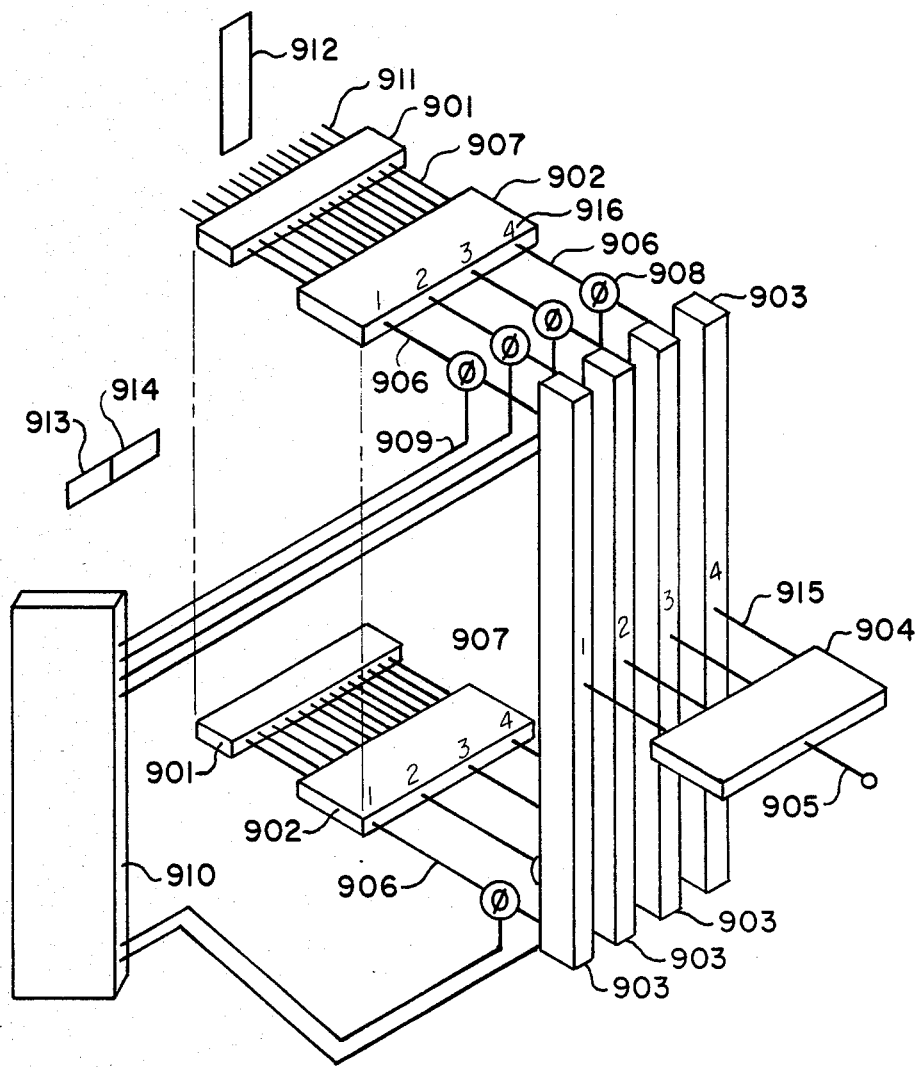
FIG. 9 is a diagram of a phased array antenna, illustrating a first embodiment of the present invention.

FIG. 9 shows a first embodiment of a phased array antenna and feed system incorporating the present invention. Each row of antennas 901, containing a plurality of antenna elements 911, is coupled to a multiple-beam-formation network 902 by means of transmission lines 907. The input ports of the beam forming networks are connected to a plurality of secondary power dividers 903 by means of transmission lines 906. The secondary power dividers 903 are connected to a primary input divider 904 by way of transmission lines 915. The input port 905 of the primary power divider accepts the entire power to be distributed and radiated by this system. A plurality of phase shifters 908 are placed in series with the transmission lines 906. The phase shifters are connected to phase controller 910 by means of control lines 909.

The antenna radiator elements 911 may be a row of dipoles, slots, horns or other types suitable for phased array antennas. The multiple-beam-formation networks may also be of any suitable type including a Butler matrix, a Blass matrix, or a lens and multiple feed assembly. The transmission lines 906 may be of arbitrary length, including zero length, however, they will generally be of equal length unless differences of length are compensated by the design of the multiple-beam-formation network.

Each beam forming network has a series of numbered input ports 916, each of which contributes power to only one beam constituent. For example, all the ports numbered three of the beam forming networks contribute to form beam constituent 913, while all the power supplied to all the ports numbered four contribute to form beam constituent 914. The power supplied to a single port of a single beam forming network such as port three of the uppermost beam forming network will produce only a beam constituent element such as beam constituent element 912. The combination of all the beam constituent elements produced by all the ports numbered three of all the beam forming networks combine to form beam constituent 913.

Signal power applied to a numbered port of the multiple-beam-formation network, will be divided and applied to the row of radiators supplied by the beam forming network with appropriate phase to establish the plurality of elemental beams. Signals applied to the like-numbered port of any other of the multiple-beam-formation networks will also each establish an elemental beam of the same shape and pointing direction, but with its phase center in the plane of the row of radiators which are being fed by the particular beam formation network involved.

In this respect, the like numbered ports are quite like the ports of a linear array of identical radiators aligned along the same column. Exciting the column of ports simultaneously create a much narrower beam constituent scanned to a direction within the coverage of the original elemental beam, the direction being dependent on the amount of linearly progressive phase shift across the like-numbered beam-ports.

The numbered input ports of each multiple-beam-formation network are coupled to the secondary power dividers 903 via transmission lines 906 in the manner shown in FIG. 9. This interconnection is such that a single power divider feeds like numbered beam ports of all the multiple-beam-formation networks. Each power divider converts a single input signal into as many output signals as there are beam-ports on the multiple-beam-formation network. Each power divider is either of the corporate or of the series type, being basically an interconnection of power splitters.

Each of the transmission lines 906 includes the series connected electronically controllable phase shifters 908. The phase shifters may be located within the secondary power dividers between branching power splitters or in series with each of its outputs as shown. These phase shifters function to provide a linear progressive phase tilt across the outputs of the power divider, which causes the steering of a constituent beam in the plane orthogonal to the plane of the rows of the array.

The phase shifters are set by the controller 910 via the interconnecting transmission lines 909. The controller is designed to cause both a common and a differential scan of the constituent beams. The common scan establishes the pointing direction of the composite beam while the differential scan adjusts the shape or the attitude of the composite beam. The differential scanning is in amounts which increase with the displacement of the constituent beams from the center of the composite beam. The differential scan is either in the same direction or in opposite directions for constituent beams on either side of that center depending on whether the objective is to compensate for coning or to compensate for attitude tilt of the antenna. The controller 910 may be analog or a digital device. The secondary power dividers 903 are themselves fed by the primary power divider 904 which appropriately splits the signal power applied to the antenna input 905.

Alternative equivalent structures are considered within the scope of this invention. For example, a transposition of the rows and columns of FIG. 9 to transpose the plane in which the fan beam is wide or other similar antenna element arrangements which permit the production of controlled beam constituents are within the contemplations of the present invention.

Figure 10:
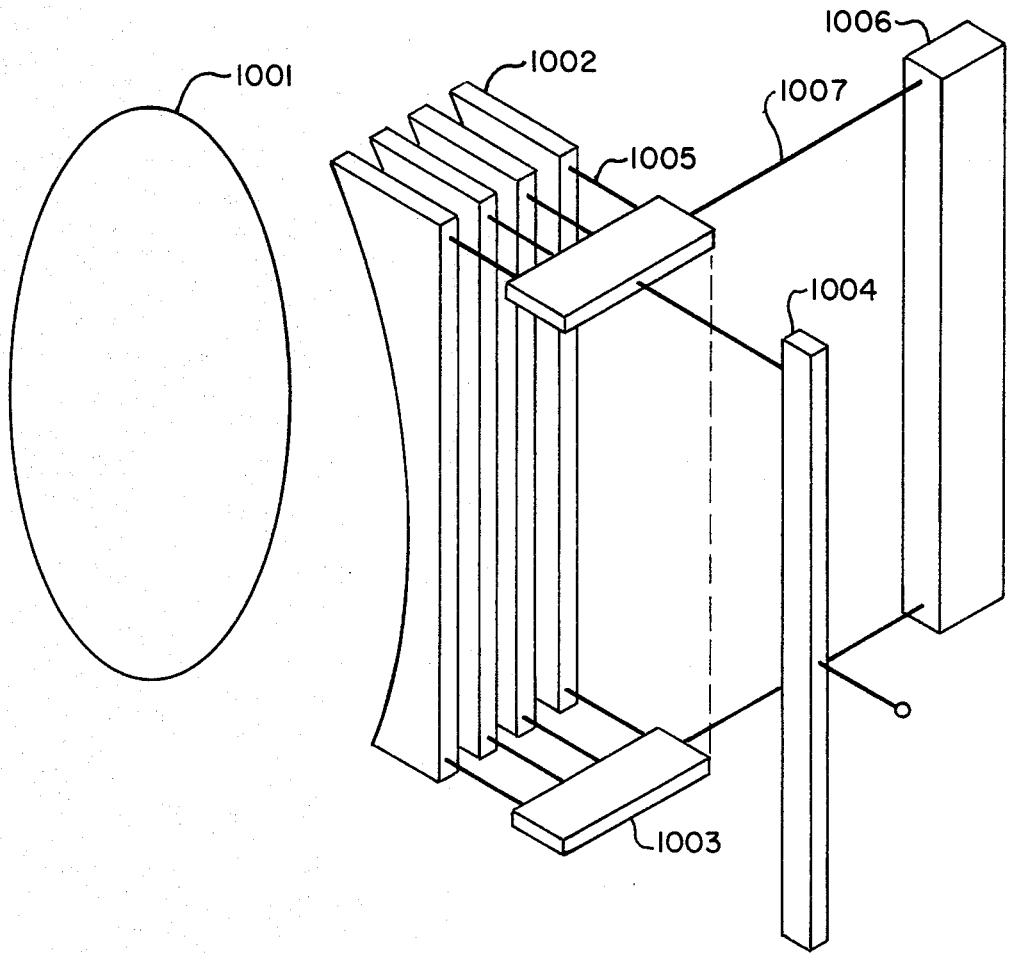
FIG. 10 is a diagram of an alternative antenna system, illustrating a second embodiment of the present invention.

A more subtle example of an alternative equivalent is shown in FIG. 10. In this case, a three-dimensional lens 1001 and column arrays of feed radiators 1002 are used to establish beam constituents. The feeds may be dipoles, slots, horns or any other radiator which can efficiently illuminate the lens. These feeds are located so that their phase centers lie along the lens' surface of best focus. The input port of each feed is, in effect, a beam port in that a signal applied to that port would cause the radiation of an elemental beam.

To establish a composite beam that is wide in the plane of a column, it is necessary to simultaneously excite many or all the feeds in one column. The particular column excited will determine the pointing direction of the composite beam. The particular column excited is in turn determined by the settings of the set of selector switches 1003. These switches are interposed in series with the lines 1005 which interconnect the columns of feeds and the power divider 1004. This divider converts the input signal into a multiplicity of constituent parts for simultaneous excitation of multiple feeds. The switches are set by the controller 1006 via the interconnecting transmission lines 1007. The controller is designed to select beams which are all within one column for the case where the beam shape and orientation are desired to be nominal. In the case where it is desired to tilt the orientation of the beam to compensate for antenna attitude changes or to curve the beam shape to compensate for coning, the controller is designed to select beams whose column position is a function of its row position, the function depending on the objective. For coning or attitude compensation, the controller progresses down the row addresses and selects beams in columns which are progressively displaced from that constituent beam, or beam pair which defines the center of the composite beam. The progressive displacement of columns is in the same direction or in opposite directions on either side of the composite beam center depending on whether the objective is to compensate for coning or to compensate for attitude tilt of the antenna.

Figure 11A:
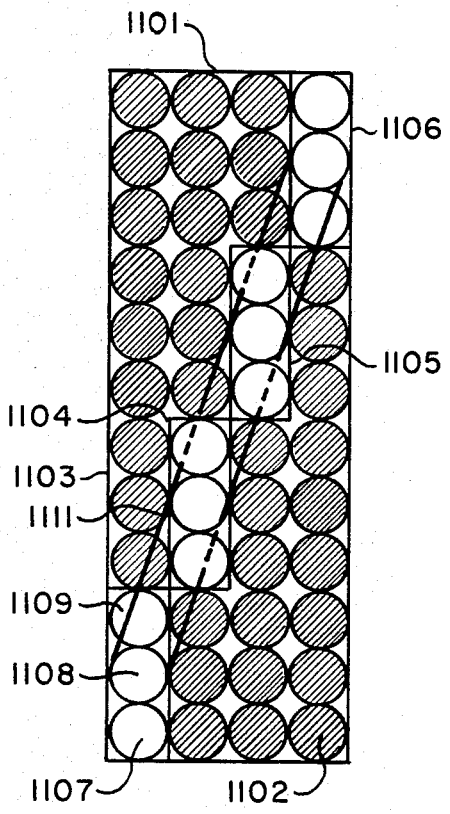
FIG. 11A is a schematic illustration of a fan beam formed by means of system of FIG. 10.
Figure 11B:
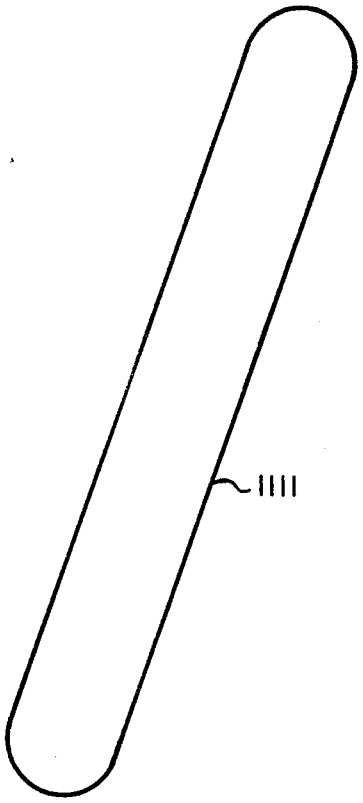
FIG. 11B shows the results of the blending of the individual beams shown in the schematic of FIG. 11A.

This alternative system may be considered as a means of selectively exciting elemental beams which when combined, form beam constituents in positions that determine the orientation of the longitudinal axis of the overall pattern. The elemental beams in this case are pencil beam unlike the fan elemental beams discussed in connection with FIG. 9. This is shown more clearly in FIG. 11A where an array of beam elements 1101 shows four beam constituents 1103 through 1106, each comprising three excited beam elements. For example, beam constituent 1103 comprises beam elements 1107 through 1109. Beam elements that are excited are light, such as element 1107, while those that are not excited are dark, such as element 1102. In the example shown in FIG. 11A, each beam constituent is offset from the next by one row of elements; however, their ends remain adjacent. The composite beam formed by these offset beam constituents is outlined by contour 1111; FIG. 11B shows this contour more clearly and includes the blending effects which tends to smooth the sharp edges at the ends of the beam constituent.

All of the alternative equivalent structures have in common the essence of the invention; this is, the means to form a multiplicity of constituent beams which have ends that are adjacent in a plane, and thereby form a composite beam that is wide in that plane; the means to independently steer the beams in the orthogonal plane; and the means to control the steering so that the composite beam direction, $\theta$, $\phi$, its shape and its orientation are as desired.

We claim:

1. Apparatus for eliminating antenna induced errors in systems utilizing fan beams, including correction of fan beam distortions in a phased array antenna caused by electronic scanning of the beam or by movement, such as roll, of the structure upon which the antenna is mounted, comprising:

(a) a phased array antenna comprising orthogonal rows and columns of antenna elements, (b) means for forming fan beam constituents, each having a generally elliptical cross section at its 3 dB level with the cross section having a longitudinal axis positioned generally in the azimuthal plane for reference purposes, and the cross sections having ends generally oriented orthogonal to the longitudinal axis, (c) means for aligning the fan beam constituents generally end to opposite end along a line with their longitudinal axis generally parallel to one another, their opposite ends adjacent one another and their centers along the line to form a single composite fan beam, the line constituting the longitudinal axis of the composite beam, the means for positioning the fan beam constituents including means for individually adjusting the position of each fan beam constituent in elevation angle, while maintaining the ends of the constituents adjacent one another to permit reorientation of the composite fan beam with respect to the horizontal plane.

2. Apparatus as claimed in claim 1, further comprising:

(a) a number of beam forming networks equal to the number of rows of antenna elements, each network having a number of input ports equal to the number of constituent beams and output ports equal to the number of antenna elements in a row, the output ports of one network being connected to only one row of antenna elements, (b) a number of phase shifters equal to the number of input ports of the beam forming network, each connected in series with only one input port of the beam forming network, and (c) means for controlling the phase shift through the phase shifters, the means for controlling the phase producing a linear progression in the phase shift of the shifters connected to the input ports of beam forming networks which are associated with only one beam constituent to produce a change in elevation of that beam with respect to the horizontal plane.

3. Apparatus as claimed in claim 2, wherein the means for controlling the phase is adjusted to compensate for coning distortion by being set to produce an increasing progression of the same sense in the scan plane positional offset of the beam constituents as the beam constituent lies farther from the center of the composite beam in the plane orthogonal to the scan plane.

4. Apparatus as claimed in claim 2, wherein the means for controlling the phase is adjusted to shift the orientation of the composite fan beam with respect to the horizontal plane by being set to produce an increasing linear progression of opposite sense in the elevation position offset of the beam constituents for beam constituents lying farther from the center, and on the opposite sides, of the composite beam.

5. A process for eliminating antenna induced errors in systems utilizing fan beams, including correction of fan beam distortions in a phased array antenna caused by electronic scanning of the beam or by movement, such as roll, of the structure upon which the antenna is mounted, comprising the steps of:

(a) providing a phased array antenna comprising orthogonal rows and columns of antenna elements, (b) providing means for forming fan beam constituents each having a generally elliptical cross section at its 3 dB level with the cross section having a longitudinal axis positioned generally in the azimuthal plane for reference purposes, the beam constituents having ends oriented generally orthogonal to their longitudinal axes, (c) providing means for positioning the fan beam constituents in elevation angle, and (d) positioning the beam constituents generally end to opposite end along a line with their axes parallel to one another, their opposite ends adjacent one another, and their centers along the line to form a composite fan beam, the line constituting the longitudinal axis of the composite beam.

6. A process for eliminating antenna induced errors in a system utilizing fan beams, as claimed in claim 5, further comprising the steps of:

(a) providing a plurality of beam forming networks, each having a number of input ports equal to the number of beam constituents and output ports equal to the number of antenna elements in a row of the antenna array, the output ports of one network being connected to the antenna elements in only one row of the antenna array, while each input port is connected to accept power for only one fan beam constituent, (b) providing a number of phase shifters equal to the total number of input ports of the beam forming networks, each connected in series with only one input port of the beam forming network, (c) providing means for controlling the phase shift through the phase shifters, and (d) adjusting the phase shifters to have a linear progression in the phase shift of the shifters connected to input ports of beam forming networks which are associated with only one beam constituent to produce a change in the elevation of that beam constituent above the horizontal plane.

7. A process as claimed in claim 6 further comprising the step of adjusting the means for controlling the phase to produce an increasing progression of the same sense in the scan plane positional offset of the beam constituents as a beam constituent lies farther from the center of the composite beam in the plane orthogonal to the scan plane.

8. A process as claimed in claim 6, further comprising the step of adjusting the means for controlling the phase to produce an increasing elevation position offset of opposite sense in elevation position for beam constituents as the beam constituent lies farther from and on opposite sides of the center of the composite beam.

* * * * *

UNITED STATES PATENT AND TRADEMARK OFFICE

CERTIFICATE OF CORRECTION

PATENT NO. : 4,532,519

DATED : July 30, 1985

INVENTOR(S) : RONALD M. RUDISH ET AL

It is certified that error appears in the above-identified patent and that said Letters Patent is hereby corrected as shown below:

On the front page of the patent, left-hand column, after the list of the inventors, insert --Assignee: Eaton Corporation, Cleveland, Ohio--

In Claim 1, column 10, line 40, delete "axis" and insert --axes--

Signed and Sealed this

*Third* Day of *December 1985*

[SEAL]

*Attest:*

*Attesting Officer*

DONALD J. QUIGG

*Commissioner of Patents and Trademarks*